United States Patent [19]

Fleishman

[11] Patent Number: 4,533,174

[45] Date of Patent: Aug. 6, 1985

[54] PORTABLE FURNITURE

[76] Inventor: Gregg Fleishman, 6071 Hargis St., Los Angeles, Calif. 90034

[21] Appl. No.: 332,151

[22] Filed: Dec. 18, 1981

Related U.S. Application Data

[63] Continuation-in-part of Ser. No. 123,903, Feb. 22, 1980, , which is a continuation-in-part of Ser. No. 866,837, Jan. 4, 1978, Pat. No. 4,202,581.

[51] Int. Cl.[3] ..... A47C 4/00

[52] U.S. Cl. ..... 297/16; 297/440; 297/457

[58] Field of Search ..... 297/440, 446, 447, 16, 297/418, 457; 248/188

[56] References Cited

U.S. PATENT DOCUMENTS

| | | | |
|---|---|---|---|
| 2,369,930 | 2/1945 | Wagner | 248/188 |
| 2,649,146 | 8/1953 | Sanford et al. | 297/418 |
| 2,649,147 | 8/1953 | Sanford | 297/447 X |
| 4,202,581 | 5/1980 | Fleishman | 297/440 |
| 4,390,204 | 6/1983 | Fleishman | 297/16 |

*Primary Examiner*—Francis K. Zugel
*Attorney, Agent, or Firm*—Lyon & Lyon

[57] ABSTRACT

There is disclosed further improved portable furniture generally comprising at least an originally planar support member having integral portions thereof adapted to be resiliently disposed and releasably secured by interlocking means in angular and/or curvilinear relationship to one another to provide for support, said support member returning to its original planar configuration when said interlocking means are disengaged to facilitate portability.

3 Claims, 25 Drawing Figures

PORTABLE FURNITURE

RELATED APPLICATION

This application is a continuation-in-part of my earlier filed U.S. patent application, Ser. No. 123,903 filed Feb. 22, 1980, entitled "Improved Portable Furniture" which, in turn, is a continuation-in-part of application Ser. No. 866,837 filed Jan. 4, 1978, which issued on May 13, 1980, as U.S. Pat. No. 4,202,581.

BACKGROUND OF THE INVENTION

The further improved portable furniture is constructed in such a manner as to optimize portability, aesthetic design, engineering practicality, simplicity of manufacture and comfort. The furniture is constructed to enable easy storage and facility of transportation, by allowing it to be disassembled and stored into a generally planar stack. This general type of furniture construction is also illustrated in the co-pending parent application, Ser. No. 123,903, filed Feb. 22, 1980, which is referred to above and incorporated herein by reference, as is U.S. Pat. No. 4,202,581.

The present invention claimed comprises other variations on and also improvements of this inventor's co-pending application. In one of the chair embodiments shown dovetail recesses formed in the bottom of the seat connect with dovetail projections on resilient arm portions of a new type of support member providing lateral support to the chair without projections above the seat member surface. In the table embodiments similar dovetail recesses formed in the bottom of the table top can connect directly with dovetail projections on the table support members eliminating the need for frame members, retainer bars or slots and notches in the table top surface itself. In all embodiments, the invention demonstrates added convenience and simplicity of connection while still allowing the advantages of portability claimed in the co-pending application.

SUMMARY OF THE INVENTION

The present invention relates to further improved portable furniture which can be easily assembled and disassembled for facile storage. While being practical, the design of the herein disclosed portable furniture is not only comfortable, aesthetically pleasing, but is of an efficient design which minimizes the problems of prior art foldable or portable furniture.

The advantages of the present invention are obtained by forming portable furniture from originally planar one-piece support members disposed generally vertically, and in most cases originally planar one piece furniture members disposed generally horizontally wherein, said support members have integral portions thereof adapted to be resiliently disposed and releasably secured by interlocking means in angular and/or curvilinear relationship to each other to allow for the support of the furniture, which, in preferred embodiments comprise portable chairs and portable tables.

For the first portable chair embodiment shown herein, the support member is provided with integral partially resilient front legs, rear legs, arms, shoulder and an almost fully resilient body portion which are all adapted to be disposed in angular and curvilinear relationship to one another and releasably secured by interlocking means. In this embodiment the body portion forms both the back and the seat elements of the resultant chair and provides for comfort by the resiliency therein. By releasing the interlocking means, the support member returns to its original planar configuration for ease of portability.

For the second portable chair embodiment shown herein the support member comprises a resilient back portion, two main portions, and two brace arm portions, while the furniture member comprises a chair seat. In the assembled configuration of the chair the back portion is bent into an approximately 180° arc around the back above the chair seat. It is integrally connected to the tops of the two main portions at each end, and the arc configuration is maintained by releasably securing the midportions of the two main portions to interlocking means on the edges of the chair seat. The tops of the main portions form arm rests for the chair occupant while the bottoms contact the ground to provide vertical and longitudinal lateral support, the brace arm portions in turn being provided on the front of the bottom of the main portion and adapted to bend angularly inward and connect to the bottom of the front part of the chair seat, an appropriate connection being an integral dovetail interlock. The resiliency of the back portion of the support member in combination with resiliency in the seat or furniture member provide for the comfort of the occupant seated therein.

The dovetail recess used comprises a slot of trapezoidal cross-section within the furniture member with the shorter of the two parallel sides of the trapezoidal cross-section coincident with the outer surface of the side of the furniture member. The cross-section of the slot varies in width such that there is a narrow latching section and a wider insertion section where the width of the narrower portion of the wider section is at least wider than the wider portion of the narrower section.

The dovetail projection used comprises an angular narrowing or a thinning near the end portion of arm portions of the planar support members such that the shape and size, either in plan or in section corresponds closely with the shape of the cross-section of the latching section of the aforementioned dovetail recess.

In the portable table embodiments, the support members are provided with main and arm portions adapted to be disposed in angular relation to one another while their end portions interlock in a releasably secure connection to the underside of the furniture member, in this case table tops. The end portions of said arm and main portions are provided with dovetail projections designed to mate with corresponding dovetail recesses in the bottom of said table tops.

It can be appreciated that the table and chair configurations are comprised of interlocking members which are selectively separable for portability by disengaging interlocking means which hold the support members in angularly displaced modes.

BRIEF DESCRIPTION OF DRAWINGS

A more thorough disclosure of the features of the present invention is set out in the detailed descriptions of the drawings which are described below.

DETAILED DESCRIPTION OF THE INVENTION

Figure 1:
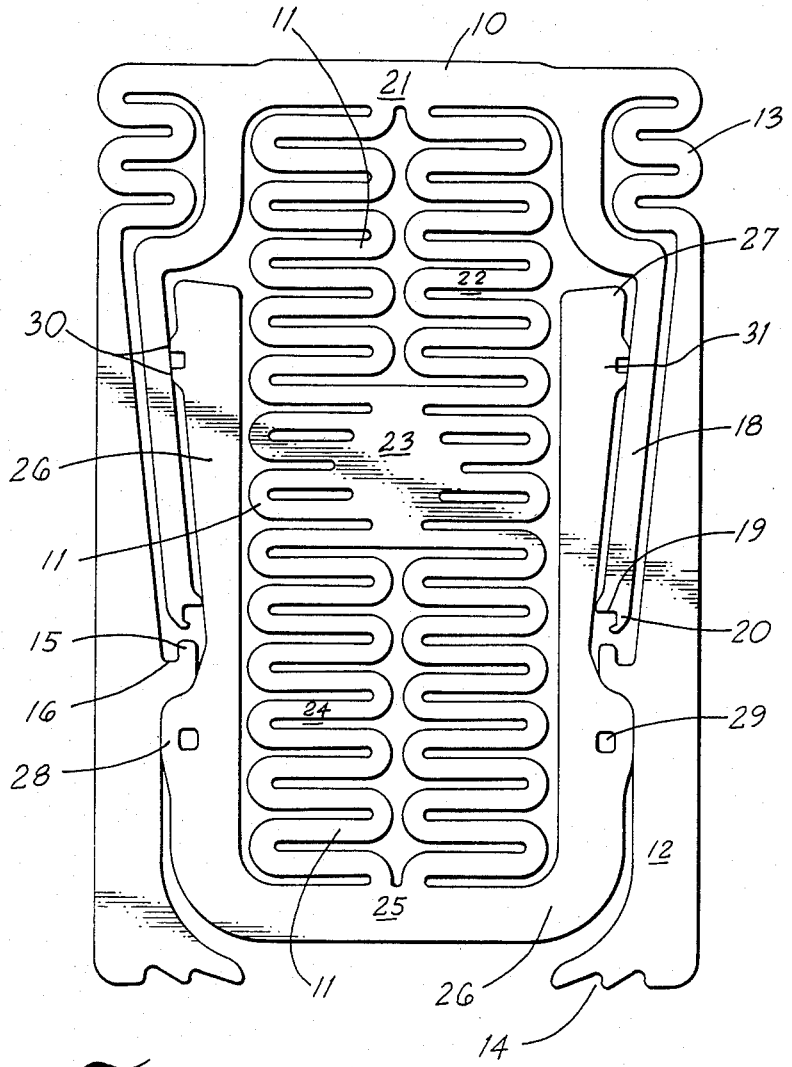
FIG. 1 is a plan view of a support member for a chair embodiment of the present invention having shoulder portion (10), body portion (11) front legs (12), arms (18) and rear legs (26).

The present invention relates to originally planar one-piece members for portable furniture, some having angularly and curvilinearly displaceable portions which provide support to portable furniture such as chairs or tables which comprise the preferred embodiments shown in the drawings.

Figure 2:
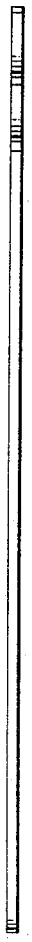
FIG. 2 is a side view of the above-mentioned support member (unassembled).
Figure 3:
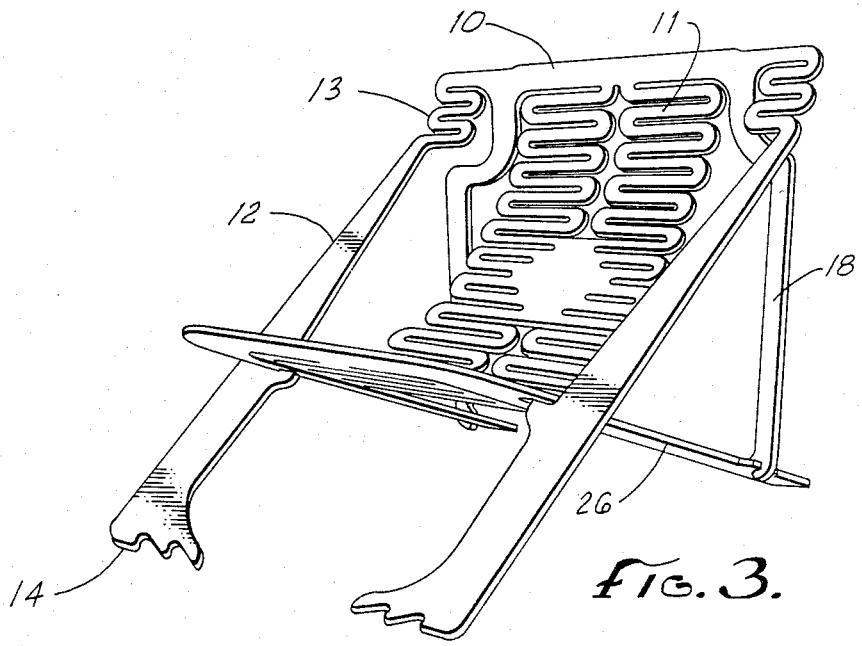
FIG. 3 is a perspective view of the assembled chair embodiment of FIG. 1.

FIGS. 1, 2 and 3 illustrate a perferred embodiment of a chair according to the present invention. FIG. 1 shows a plan view of a support member or originally planar form which integrally encompasses all of the components necessary in the assemblage of the final form. The member is comprised of primarily five parts, a shoulder portion 10, arm portions 18, rear legs 26, front legs 12, and a body portion 11. The rear leg portions are connected to the body portion at point 25, the body portion is connected to the shoulder portion at point 21, the shoulder merges with the arms 18 and is also connected to the front legs 12 at shoulder joint 13. While all of these elements are integral with each other thereto, the resiliency contained in the shoulder joint area 13 and the body portion 11 allows for their displacement into the form as shown in FIG. 3, recognizable as a chair for the purpose of seating an individual therein. The interlocking means for maintaining the assembled chair configuration comprise ledge 16 and thumb 15 on front leg 12 which support and interact with void 29 and spot 28 on rear legs 26. In addition, fingers 20 on arms 18 fit between bumps 30 on rear leg 26 while surface 19 is supported on spot 31. Rear feet 27 and front feet 14 are in contact with the ground or floor surface.

It can be appreciated that the loops as indicated at shoulder area 13 and portions of the body area 22 and 24 define an extended and circuitous stress path which results in increased flexibility, thus allowing for the displacement into the angular-curvilinear form. It should be noted that the characteristic loop pattern is only necessary when the support member is formed from a material more plastic in nature and the increased flexibility could result from other means such as a variation in material thickness. Additionally, the invention is not to be limited to embodiments where all portions of the improved furniture are manufactured from the same materials. The more flexible areas can be made from different materials from other portions to similarly provide for angular and/or curvilinear displacement. It is only necessary that these materials be connected so that they perform in an integral manner.

Body area 11 contains flexible portion 22 which constitutes the chair back in combination with optional solid area 23, located to correspond to, and help provide support for, the lumbar area of the spine. Solid area 23 is in turn connected to flexible area 24 which forms the chair seat. Note that the shape of front feet 14 demonstrate the playfullness possible in detailing for the aesthetics of the final form.

In order to assemble the chair, first the body portion 11 is lifted upward and outwardly from point 25 until voids 29 on rear legs 26 oppose and are above thumbs 15 on front legs 12. Body portion 11 thereafter is lowered so that spots 28 on rear legs 26 contact ledges 16 on both frong legs 12. Next, arm portions 18 are moved rearwardly and outwardly until filgers 20 fit between bumps 30 on rear legs 26 and surface 19 on arms 18 contacts spot 31 on rear legs 26.

It can be appreciated that gravity contributes to the downward force necessary to keep voids 29 of rear legs 26 engaged with thumbs 15 of front legs 12 while the rigidity of rear legs 26 and arms 18 merging through shoulder area 10 aids in maintaining engagement of fingers 20 with bumps 30. Arms 1 are also subjected to outward pressure sufficient to engage fingers 20 with bumps 30 during assembly.

Figure 4:
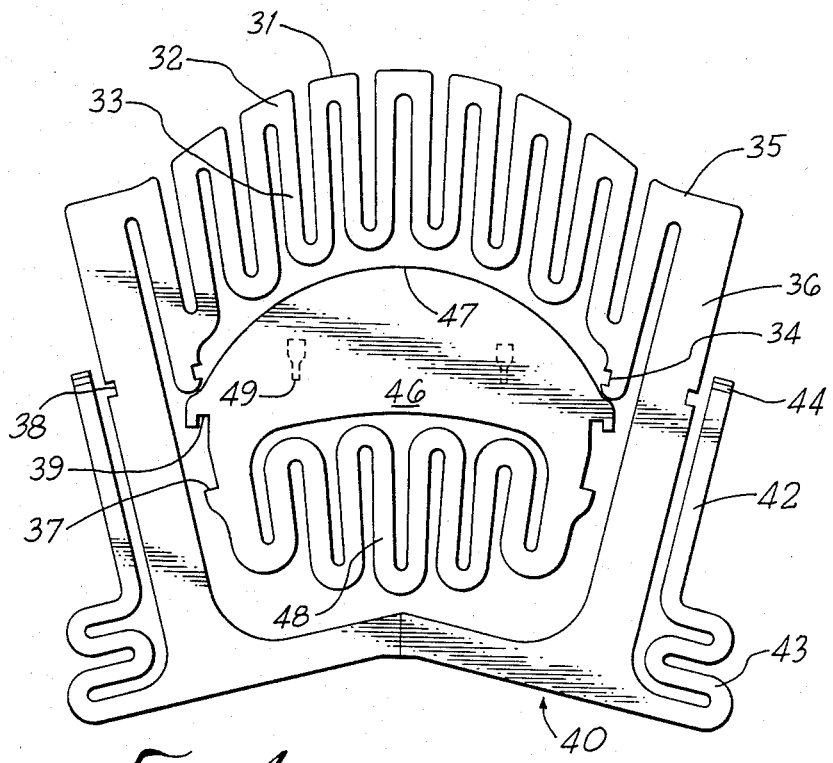
FIG. 4 is a plan view for a second chair embodiment showing a support member (31) having back portion (32), main portions (36), and brace arm portions (42) in conjunction with a plan view of the complimentary furniture member or chair seat (46).
Figure 5:
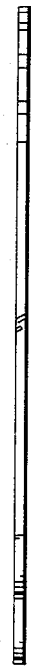
FIG. 5 is a side view of the elements of FIG. 4 (unassembled).
Figure 7:
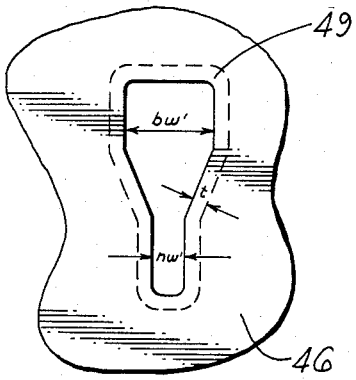
FIG. 7 is a detail plan view from below, of the dovetail recess (49) for connection to a section oriented dovetail projection.
Figure 6:
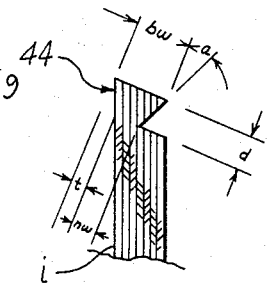
FIG. 6 is a detail section view of the dovetail projection (44) of arms (42).
Figure 8:
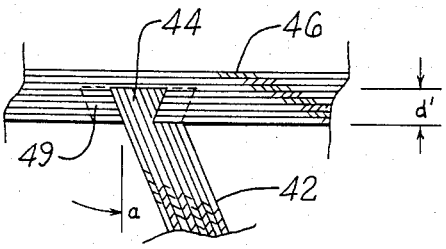
FIG. 8 is a detail section view of the interlocked dovetail connection of the elements shown in FIGS. 6 and FIG. 7.
Figure 9:
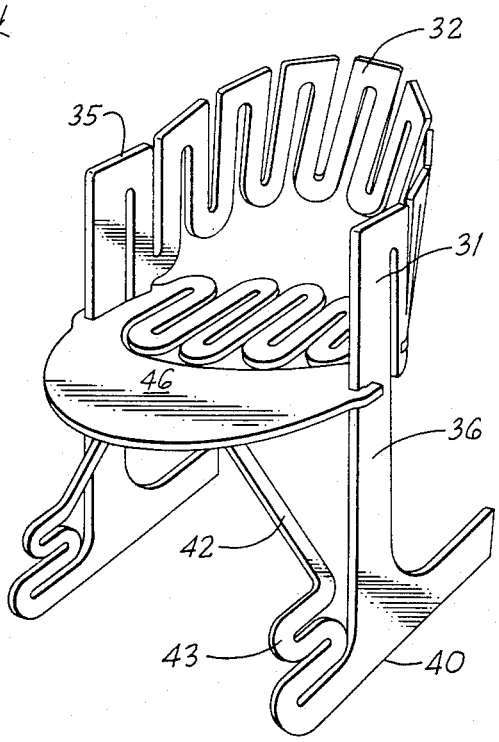
FIG. 9 is a perspective view of the assembled chair embodiment of FIG. 4.

FIGS. 4 through 9 illustrate another portable chair in the preferred embodiment of the present invention, FIG. 4 showing the plan view of the support member 31 and the seat member 46 which demonstrates the ingenuity and the material efficiency of the design, FIG. 5 showing the planarity of the pieces when unassembled, FIGS. 6, 7 and 8 showing the details of the releasably secure dovetail interlock, and FIG. 9 showing a perspective view of the assembled chair.

In FIG. 4 there is shown both the support member 31 and the furniture member or chair seat 46. The support member 31 comprises a resilient back portion 32, two main portions 36 and two brace arm portions 42. The back portion 32 is formed radially or fan-shaped in such that the degrees of arc difference between the angle of the two ends at its connection to main portions 36 at point 35 determine the rearward slope of the back 32 in its assembled configuration.

Back portion 32 consists of loops 33 such that the circuitous and extended stress path provides for flexibility. The last loop 33 at either end contains notches 34 used in connecting to bump 37 on the chair seat 46. Main portions 36 contain notches 38 on their front edges for interlocking with notches 39 on chair seat 46. Main portions 36 contact the ground at edge 40 providing front and rearward stability. Main portions 36 are also connected to brace arm 42 at area 43 where the circuitous stress path allows for angular displacement of the brace arms 42. The ends of the arms 42 contain dovetail projections 44 which interlock with dovetail recesses 49 in chair seat 46 to provide for transverse lateral stability of the chair without any projections through the chair seat at the points of connection. The rear portion of chair seat 46 contains loops 48 also to provide for flexibility.

FIG. 6 shows a detail section view of dovetail projection 44 for use in connection with dovetail recess 49 shown in FIG. 7. When interlocked as shown in FIG. 8, the angular displacement of brace arm 42 is equal to the dovetail angle a, and the length of brace arm 42 is determined so that the main portion 36 remain vertical when assembled. Also shown in FIG. 6 are dimensions nw, bwand d which are to be differentiated from dimensions nw', bw' and d' shown in FIGS. 7 and 8 which are all slightly greater to allow for ease of assembly and disassembly. The fore and aft location of dovetail recess 49 is determined in relation to a transverse line between the base of notches 39 such that the narrower or latching section nw' is further from that line than is the dimension between the base of notch 38 and brace arm 42 when support member 31 is unassembled and at rest. This greater dimension stresses the assembled form thus maintaining it in a releasably secure interlock.

In order to assemble the chair as shown in FIG. 9, the seat portion 46 is grasped by front edge 47 with bottom side (containing dovetail recesses 49) facing assembler and main portion 31 laying flat on the floor surface with inner Iside up indicated by i in FIG. 6 and edges 40 adjacent. One brace arm 42 is grasped and lifted upward until angular displacement clears dovetail projection 44 from in front of notch 38 and seat 46 with notch 39 can be interconnected with the same. Brace arm 42 is then moved until it opposes portion bw' of recess 49 after which time it is inserted and then allowed to spring backward interlocking bw with nw'. To repeat the process with the other side, the assembler kneels on already assembled main portion 36 at bottom edge 40 and lifts and rotates the other main portion 180 degrees pushing brace arm 42 down to clear the seat as he approaches the final position. Notches 38 and 34 are connected with notch 39 and bump 37 and brace arm 42 is inserted in recess 49 as before. In the assembled chair, the bottoms of notches 38 and 34 provide vertical support to the chair seat while the outside portion at notch 39 and the inside portion at bump 37 provide the contact points to maintain the 180 degree rotation of the chair back.

To disassemble the chair, one brace arm 42 is disconnected from chair seat 46. Loop portion 33 at notch portion 34 on same side of chair is then lifted outward over bump 37 and moved backward releasing notches 38 and 39. The back portion 32 then flattens out and steps are repeated on the other side.

It can be appreciated that both chair embodiments according to the present invention are comprised of originally planar members having integral portions adapted to be resiliently disposed and releasably secured in angular and curvilinear relation to one another yet return to their original planar modes when interlocking means are disengaged to facilitate portability.

Figure 10:
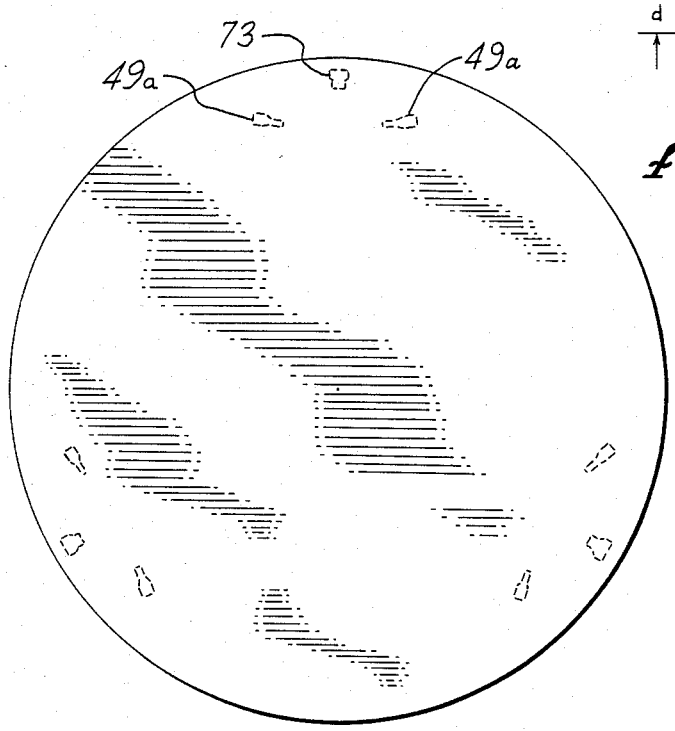
FIG. 10 is a plan view of a furniture member or table top (62) showing dovetail recesses (73) and (49) according to the present invention.
Figure 12:
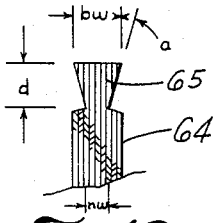
FIG. 12 is a section view of the dovetail projection (65).
Figure 13:
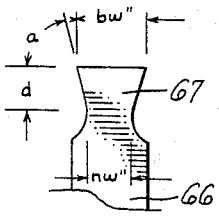
FIG. 13 is a detail plan view of the dovetail projection (67).
Figure 11:
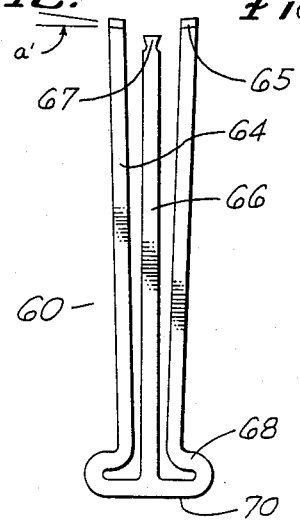
FIG. 11 is a plan view of a support member or table leg (60) for use with table top of FIG. 10.
Figure 14:
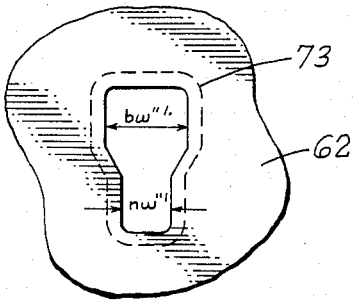
FIG. 14 is a detail plan view from below, of a dovetail recess (73) for connection to a plan oriented dovetail projection (67).
Figure 15:
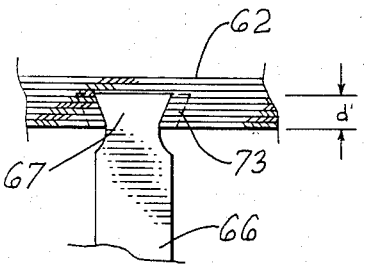
FIG. 15 is a detail section view of the interlocked dovetail connection of (67) and (73).
Figure 16:
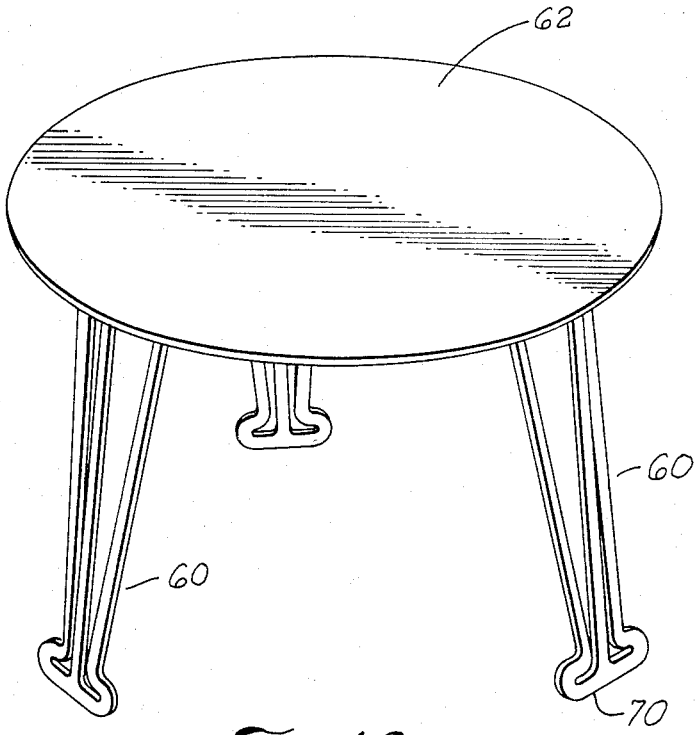
FIG. 16 is a perspective view of the assembled table utilizing the support members of FIG. 11 and the furniture member of FIG. 10.

Turning now to FIGS. 10 through 16, there is shown a preferred embodiment of a table formed according to the present invention. FIGS. 10, 11 and 16 show a plan view of the furniture member or table top 62, a plan view of the support member or table leg 60, and a perspective view of the assembled table, consecutively. FIGS. 12 through 15 show details of releasably secure dovetail interlock for use with same.

The table top 62 is shown from above its dovetail recesses for attachment of three support members 60 shown dotted. Each support member 60 shown in FIG. 11 has two brace arms 64 adapted to be angularly displaced and one main portion 66 oriented mostly vertically integrally connected thru area of increased resiliency 68 near ground contact point 70. Each brace arm 64 has section oriented dovetail projection 65 at its top end shown in FIG. 12, while main portion 66 has a plan oriented dovetail projection 67 more clearly shown in FIG. 13. Dovetail angle a and depth d is the same in both projection types although neck width and base width indicated by nw'' and bw'' are greater in projection type 67. Correspondingly, dovetail recess 73 shown in FIG. 14 for use with dovetail projection 67 shown assembled in section view in FIG. 15 has dimensions nw''' and bw''' which are both slightly greater than nw'' and bw'' to allow for assembly. Dovetail recess 49 shown in FIG. 7 for use with the previously described chair embodiment is of appropriate dimensions for use with projections 65 although angle of incidence a' of brace arm to furniture member plane is in opposite axis from that shown in FIG. 8.

In order to assemble the table, the table top 62 is laid upside down on the floor or ground surface to make it most convenient for the legs to be attached in turn. The main portion 66 of a table leg 60 held upside down is then angularly displaced outwardly from the two brace arms 64 in a plane perpendicular to the plane of the surface of the element until end portion 67 clears end portions 65 sufficiently for insertion into section bw''' of recess 73. End portion 67 then slips into section nw''' of recess 73 and is held in by contact of the adjacent dovetail surfaces. Brace arms 64 are now moved outwardly in a plane parallel to the surface of the element until end portions 65 oppose portions bw' of recess **49*a* after which they are inserted and slipped into portion nw'. Note that dovetail recesses 49***a* and 73 are located in table top 62 such that the dimensions between them are greater than the dimensions between end portions 65 and 67 when the support member is at rest. The resiliency inherent in support member allows for its insertion while still providing continuous inward pressure to maintain the interlock. The triangularity of the recess locations result in angular displacement of the support member which provides for stability in both plan axis.

Figure 17:
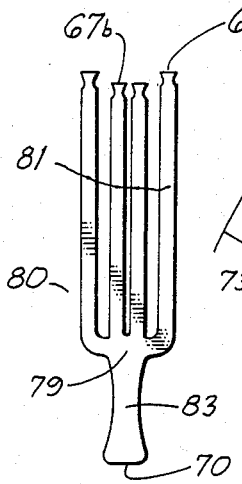
FIG. 17 is a plan view of another possible embodiment of a support member (80) or table leg according to the present invention.
Figure 18:
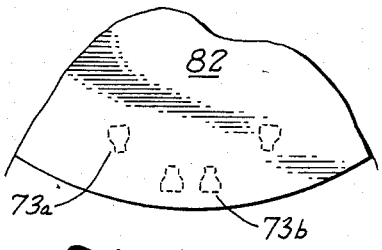
FIG. 18 is a partial plan view of a furniture member (82) or table top with dovetail recesses (73) shown dotted for use with the support member of FIG. 17.
Figure 21:
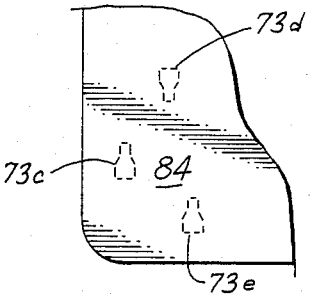
FIG. 21 is a partial plan view of a furniture member (84) or table top, with dovetail recesses (73) shown dotted for use with the support member of FIG. 10.
Figure 20:
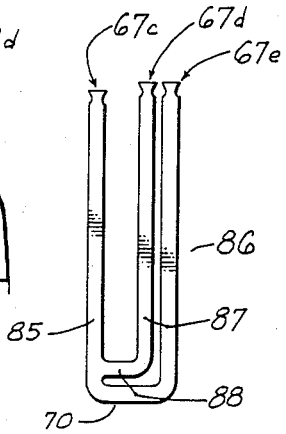
FIG. 20 is a plan view of another possible embodiment of a support member (86) or table leg according to the present invention.
Figure 19:
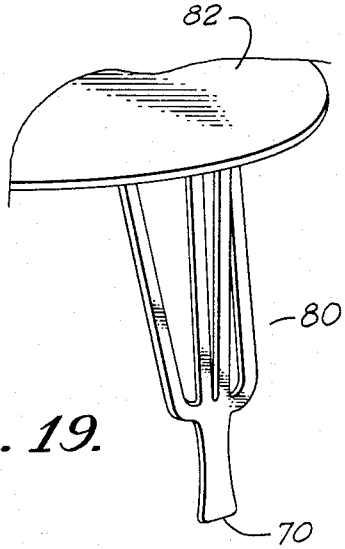
FIG. 19 is a partial perspective view of the assembled configuration of the support member of FIG. 17 and the furniture member of FIG. 18.
Figure 22:
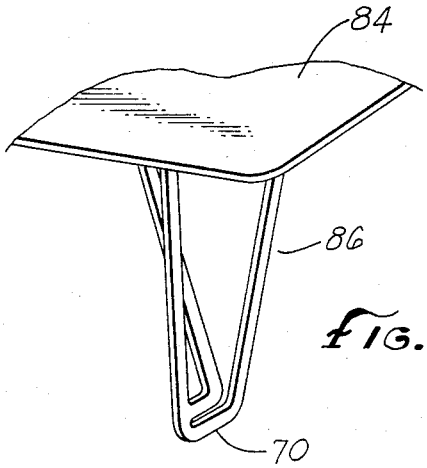
FIG. 22 is a partial perspective view of the assembled configuration of the support member of FIG. 20 and the furniture member of FIG. 21.
Figure 23:
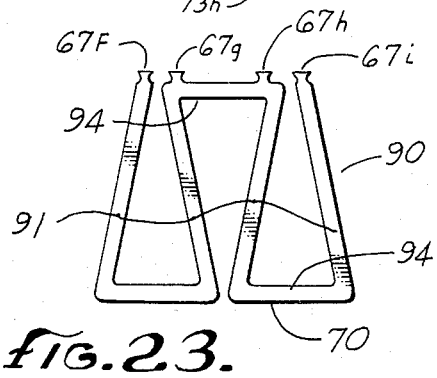
FIG. 23 is a plan view of another possible embodiment of a support member or table leg (90) according to the present invention.

The table tops can be made in different configurations and supported on different numbers of support members, three variations of which are shown in FIGS. 17 thru 25. The support members 80, 86, and 90, shown in FIGS. 17, 20, and 23 are all made as originally planar elements containing various integrally formed brace arms and main portions adapted to be resiliently and angularly displaced relative to one another and releasably secured to horizontal furniture members to provide for support, the support members returning to their original planar mode when disengaged to facilitate portability. Interlocking means used with these embodiments are dovetail projections and dovetail recesses in appropriate configurations to relate to the alignment of the various brace arms and main portions of the support members.

FIG. 17 shows a plan view of support member 80 comprising four brace arms 81 connected to main portion 83 at spot 79. Dovetail projections 67*a* and *b* at top of brace arms are connected to dovetail recesses 73*a* and *b* in table top segment 82 shown in FIG. 18. Dimensions between recesses in table top 82 in both plan axis are greater than dimensions between projections on brace arms of support member when at rest fixing angularity to provide for stability of table leg in assembled mode shown in FIG. 19.

FIG. 20 shows a plan view of support member 86 comprised of two brace arms 87 connected to main portion 85 at lateral segments 88. The brace arms and the main portion have plan oriented dovetail projections 67*c, d,* and *e* at their top end for connection with recesses 73*c, d,* and *e,* correspondingly shown in partial table top segment 84 in FIG. 21. In this case the stability due to angularity is present only on the axis perpendicular to the surface of the support member while lateral stability parallel to that plane is provided by the greater rigidity of the element in that direction in combination with the moment resistance resulting from the attachment of the brace arms to the table top surface a distance apart equal to the length of lateral segment 88 at ground contact point 70. The assembled configuration just described is shown in partial perspective view in FIG. 22. The assembly procedure is similar to that already described.

Figure 24:
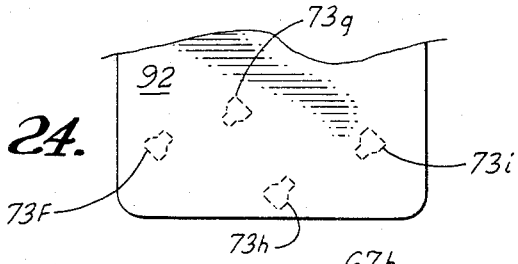
FIG. 24 is a partial plan view of the furniture member or table top (92) with dovetail recesses (73) shown dotted for use with the support member of FIG. 23.
Figure 25:
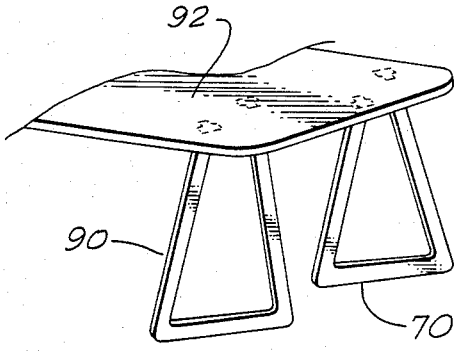
FIG. 25 is a partial perspective view of the assembled configuration of the support member of FIG. 23 and the furniture member of FIG. 24.

The last preferred embodiment shown formed according to the present invention is presented if FIGS. 23,24, and 25. FIG. 23 shows a plan view of support member 90 composed of four brace arms 91 connected by three lateral segments 94. Support member 90 has four dovetail projection 67*f, g, h,* and *i* which interlock with dovetail recesses 73*f, g, h,* and *i* formed in furniture member 92 shown in partial plan view in FIG. 24. Once again lateral resistance in a plane perpendicular to the plane of the surface of the support member is provided by the angular displacement of the brace arms allowed by torqueing lateral segments 94, while lateral resistance parallel to the surface of the plane of the support member is provided by the rigidity of the element and by moment resistance resulting from the attachment points located as far apart as the plan dimension location of the dovetail projections. To assemble this embodiment, dovetail projections 67*g* and 67*h* are first inserted in the wide parts of recesses 73*g* and 73*h* while the remaining two brace arms are angularly disposed toward their final connection points to allow for clearance. The support member is rotated so that the dovetail projections lock releasably securely in the narrower portions of the recess and the other brace arms are further disposed until opposite their corresponding recesses. After insertion, the complete assembly appears as shown from above in FIG. 25.

While embodiments and applications of this invention have been shown and described, it is apparent to those skilled in the art that many more modifications are possible without departing form the inventive concepts herein described. For example, it would be obvious to one skilled in the art to provide other means to releasably secure the support members in their angularly displaced mode, or for different configurations of main members, arm members, curvilinear loops and the like. The invention, therefore, is not to be restricted except as is necessary by the prior art and by the spirit of the appended claims.

I claim:

1. Portable furniture generally comprising at least one uniformly thick originally planar support member and a uniformly thick originally planar furniture member, wherein said furniture member is a chair seat, said support member having integral portions adapted to be resiliently disposed in angular and curvilinear relationship to each other providing for support, said support member having integral interlocking means for releasably securing said integral portions in said angular and curvilinear relationship, said support member able to return to its original planar form when said interlocking means are disengaged, said support member generally oriented vertically and said furniture member generally oriented horizontally, said interlocking means additionally releasably securing said furniture member to said support member, said integral portions of said support member comprising a back portion, two L-shaped main portions, and two brace arm portions, said back portion and the lower part of said brace arm portions comprised to be relatively more flexible and resilient than said other portions, said back portion formed generally fan shaped and connected to the tops of said two "L"-shaped main portions at each end, said "L"-shaped main portions in opposed orientation angling down and inwardly, when said furniture is in its assembled mode, said main portions are held vertically opposing each other by said interlocking means on side edges of said chair seat with the back portion in a rearward tilting cylindrical arc connected therebetween, said main portions contacting the ground surface in parallel configuration pointing rearwardly with the front edges of said main portions integrally connected to the lower part of said brace arm portions, said brace arms adapted to be angularly disposed inwardly with the top ends of said brace arms having interlocking means to the front of the bottom of said chair seat, said back portion generally resiliently conforming to the shape of a seated person when said support and furniture members are in their assembled condition, said members able to return to their original planar modes when disengaged.

2. The portable furniture of claim 1 wherein said more flexible and resilient portions are comprised of curvilinear loops.

3. The portable furniture of claim 1 wherein the interlocking means in the bottom of said chair seat are comprised generally of two trapezoidal cross-sectioned slotted recesses formed within and with the shorter of the two parallel edges of the trapezoid open and coincident with the bottom side of said chair seat, said top ends of said angularly disposed brace arms with projections of a shape similar but slightly smaller than the trapezoidal slotted recess to be joined in the bottom of said chair seat, said shape of said projection is angularly oriented when in section to correspond to its angle of interlock with the surface of said chair seat, said trapezoid cross-sectioned slotted recess varying in width such that it has a wider insertion section as well as the narrower latching section wherein the narrowest part of the wider section is wider than the wider part of the narrower section, said slotted recess is located relative to the portion of said brace arms to be joined such that the resiliency within said brace arm maintains its projecting portion within the narrower part of the slotted recess when the furniture is in its assembled condition.

* * * * *